US006619340B2

(12) United States Patent
Kondo et al.

(10) Patent No.: US 6,619,340 B2
(45) Date of Patent: Sep. 16, 2003

(54) LIQUID METERING AND FILLING LIFTER FOR CONTAINERS

(75) Inventors: Masakatsu Kondo, Tokushima (JP); Yoji Nishio, Tokushima (JP); Yasuji Fujikawa, Tokushima (JP); Michio Ueda, Tokushima (JP)

(73) Assignee: Shikoku Kakoki Co., Ltd., Tokushima (JP)

( * ) Notice: Subject to any disclaimer, the term of this patent is extended or adjusted under 35 U.S.C. 154(b) by 0 days.

(21) Appl. No.: 09/960,976

(22) Filed: Sep. 25, 2001

(65) Prior Publication Data

US 2002/0036027 A1 Mar. 28, 2002

(30) Foreign Application Priority Data

Sep. 28, 2000 (JP) ..... 2000-296790

(51) Int. Cl.[7] ..... B65B 43/42; B67C 3/00

(52) U.S. Cl. ..... 141/152; 141/172; 141/177; 141/253; 141/266; 141/275

(58) Field of Search ..... 141/84, 148–152, 141/172, 177, 253, 257, 266, 275–278; 198/468.8

(56) References Cited

U.S. PATENT DOCUMENTS 5,370,163 A * 12/1994 Owen ..... 141/177

FOREIGN PATENT DOCUMENTS

| | | |
|---|---|---|
| EP | 0 545 483 | 6/1993 |
| EP | 0 545 483 A1 | 6/1993 |
| EP | 0 648 676 A1 | 4/1995 |
| JP | 5-147695 | 6/1993 |

* cited by examiner

*Primary Examiner*—Timothy L. Maust
(74) *Attorney, Agent, or Firm*—Armstrong, Westerman & Hattori, LLP

(57) ABSTRACT

A liquid metering and filling lifter for use with different kinds of containers (C) having different heights for moving the container (C) upward and downward with a stroke corresponding to the height of the container (C) in filling a liquid into the container, the lifter comprising a container pushing-up vertical lift rod (32) disposed below a filling nozzle (13) above a bed (11) and extending through the bed (11), the lift rod (32) having a container support (31) fixed to an upper end thereof, a container pushing-down vertical lift rod (34) extending through the bed (11) at one side of the lift rod (32) and having a container holder (33) fixed to an upper end thereof, and coupling means (35) disposed below the bed (11) for coupling the two lift rods (32), (34) to make the lift rods movable upward or downward together and uncoupling the lift rods (32), (34) to make the lift rods movable upward or downward individually.

6 Claims, 4 Drawing Sheets

LIQUID METERING AND FILLING LIFTER FOR CONTAINERS

FIELD OF THE INVENTION

The present invention relates to a lifter for use with different kinds of containers having different heights for moving the container upward and downward with a stroke corresponding to the height of the container in filling the container with a liquid in an amount corresponding to the height of the container.

As disclosed in JP-A No. 5-147695 (EPC 0 545 483), conventional lifters of the type mentioned are adapted for use in a liquid filling apparatus comprising a container conveyor provided on a bed, and a filling nozzle disposed above a path of transport of containers. The known lifter comprises a container pushing-up vertical lift rod disposed below the filling nozzle and extending through the bed, a container pushing-down vertical lift rod extending through the bed at one side of the lift rod, a horizontal connecting bar positioned below the bed and interconnecting the two lift rods, a container support fixed to the upper end of the container pushing-up lift rod, a container holder so disposed as to be movable upward and downward along the container pushing-down lift rod, a chuck for setting the container holder in position above the bed relative to the container pushing-down lift rod adjustably in position so as to determine the spacing between the container support and the container holder in corresponding relation with the height of the container, and a release mechanism for the chuck.

Since the chuck and the release mechanism therefor are provided above the bed in the vicinity of the filling nozzle, the lift described has the problem that the construction of the lifter is complex around the filling nozzle above the bed.

SUMMARY OF THE INVENTION

An object of the present invention is to provide a liquid metering and filling lifter for use with containers which has a simplified construction around the filling nozzle above the bed.

The present invention provides a liquid metering and filling lifter for use with different kinds of containers having different heights for moving the container upward and downward with a stroke corresponding to the height of the container in filling a liquid into the container, the lifter comprising a container pushing-up vertical lift rod disposed below a filling nozzle above a bed and extending through the bed, the lift rod having a container support fixed to an upper end thereof; a container pushing-down vertical lift rod extending through the bed at one side of the lift rod and having a container holder fixed to an upper end thereof; and coupling means disposed below the bed for coupling the two lift rods to make the lift rods movable upward or downward together and uncoupling the lift rods to make the lift rods movable upward or downward individually.

With the lifter of the present invention, the two lift rods are coupled or uncoupled as required by coupling means below the bed, and the components provided above the bed are limited only to the portions of the two lift rods projecting upward beyond the bed, the container support and the container holder. In fact, there are none of coupling means and the like above the bed. Accordingly, the lifter is simple in its construction in the vicinity of the filling nozzle above the bed, and the parts around the filling nozzle can be cleaned very effectively to ensure sanitation and the ease of maintenance.

The coupling means comprises a connector interconnecting the two lift rods, and the connector is fixed to one of the lift rods and disengageably engaged with the other lift rod shiftably longitudinally thereof. It is then possible to alter the stroking position of the two lift rods due to a change in the height of containers, merely by shifting one of the two lift rods longitudinally thereof relative to the connector before coupling.

The coupling means has a connector fixed to the container pushing-up lift rod, and the connector is provided with a vertical rod bore having the container pushing-down lift rod slidably inserted therethrough, the container pushing-down lift rod having a plurality of engaging bores radially extending therethrough and arranged at intervals corresponding to the differences between the containers in height, a connecting rod being movable into or out of the connector radially of the rod bore and selectively fittable into one of the engaging bores when moved into the connector. It is then possible to readily alter the stroking position of the two lift rods due to a change in the height of containers, merely by fitting the connecting rod into one of the engaging bores. Additionally, the container holder can then be set in position correctly relative to the container pushing-down lift rod with respect to the direction of rotation.

When the liquid metering and filling lifter further comprises lock means for releasably locking the container pushing-down lift rod at a bottom dead center of the lift stroke thereof, a piston rod can be fitted into required one of the engaging bores by the operation of a fluid pressure cylinder, after moving the container pushing-up lift rod upward or downward along with the connector, with the container pushing-down lift rod locked by the lock means, halting the connector at a required position and positioning the piston rod as opposed to the required engaging bore. Accordingly, the piston rod can be very readily fitted into the required engaging bore which is selected with extreme ease.

The container pushing-down lift rod is provided in an outer surface thereof with a horizontal engaging groove, and the lock means has an engaging member movable into or out of the engaging groove when the container pushing-down lift rod is positioned at the bottom dead center of the lift stroke thereof. The lift rod can then be locked easily by the lock means.

A vertical endless belt is disposed along a path of upward and downward movement of the connector, with a one-side straight moving portion of the belt opposed to the path, the connector being fixed to the straight moving portion, and the endless belt is driven by a motor which is variable in the amount of rotation. The two lift rods are then movable upward and downward with a variable stroke by the smooth operation of belt drive.

DESCRIPTION OF THE PREFERRED EMBODIMENT

An embodiment of the present invention will be described next with reference to the drawings.

The term "front" as used in the following description refers to the side of the plane of FIG. 1 away from the viewer's side and perpendicular to the plane (toward the direction of the arrow A in FIG. 1), and the opposite side is referred to as "rear." The term "left" and "right" refer respectively to the left and right sides (left-hand and right-hand sides of FIG. 1) of the illustrated device as it is seen from the rear forward.

Figure 1:
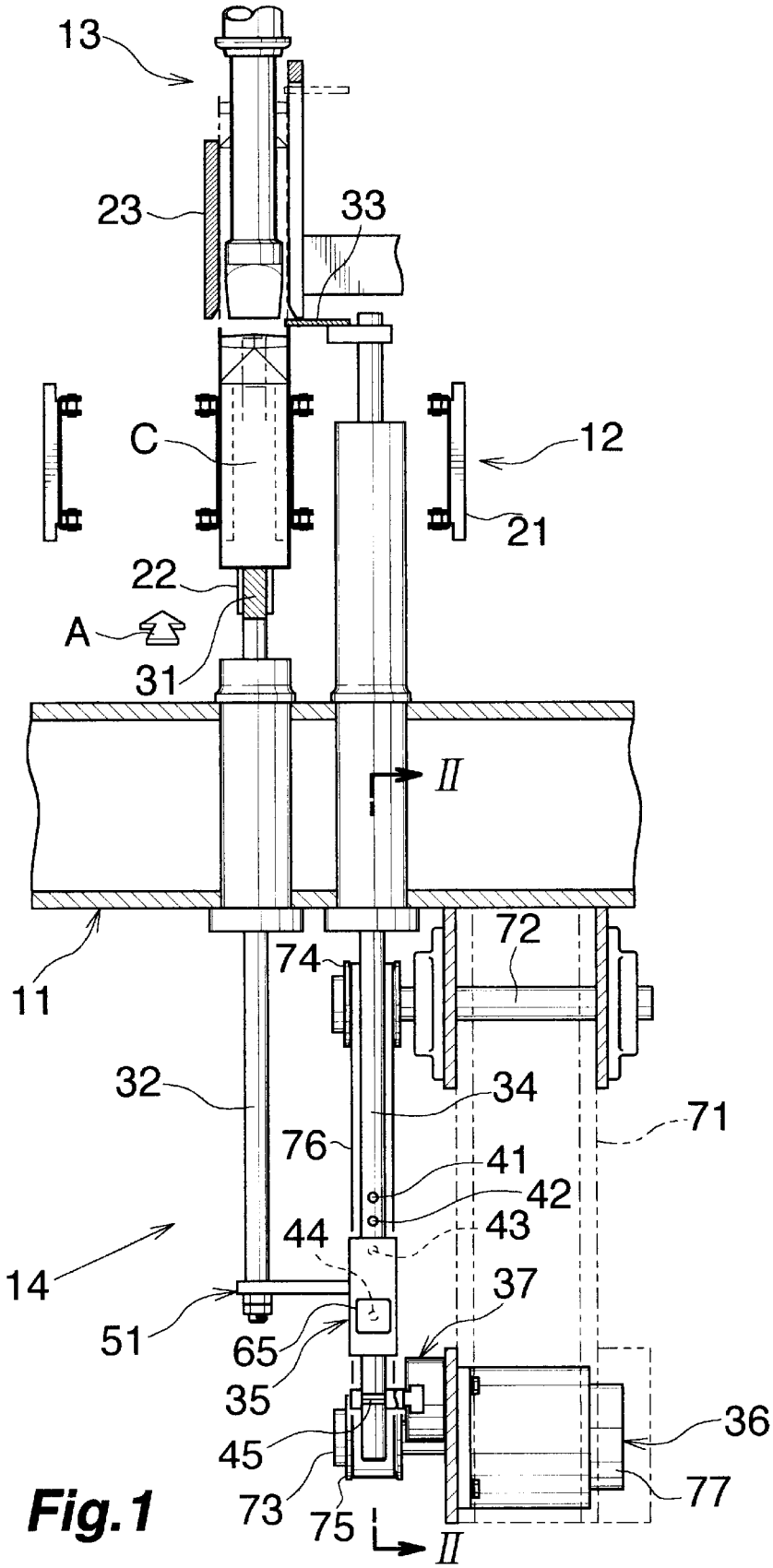
FIG. 1 is a view in vertical cross section showing a lifter of the invention and the surroundings thereof.

FIG. 1 shows a liquid metering and filling device for filling a liquid into four kinds of containers C which are different in height although having the same horizontal cross section, in quantities corresponding to the different heights.

The liquid metering and filling device comprises a container conveyor 12 having a forwardly extending transport path provided on a bed 11, a filling nozzle 13 disposed above the transport path and a lifter 14 for raising and lowering the container C by a stroke corresponding to the height of the container C for filling.

The container conveyor 12 comprises holders 21 for holding containers C so as to restrain the containers C from moving horizontally while rendering the containers C free to move vertically, a rail 22 disposed below and in parallel to the path of travel of the holders 21 for receiving the bottom of each container C as held by the holder 21 to guide the container C, and height adjusting means (not shown) for adjusting the level of the rail 22 so that the upper ends of containers C of different heights as received by the rail 22 will be positioned at a constant level.

The filling nozzle 13 is connected to an unillustrated metering cylinder, by which the liquid to be filled is supplied to the filling nozzle 13 in a specified quantity at a time in corresponding relation with the height of the container C. Disposed close to the filling nozzle 13 is a lift guide 23 for the container C to be raised by the lifter 14.

The lifter 14 comprises a vertical lift rod 32 disposed below the filling nozzle 13 and having a container support 31 fixed to its upper end for pushing up the container, a vertical lift rod 34 disposed at the right of the rod 32 and having a container holder 33 fixed to its upper end for pushing the container down, a coupling mechanism 35 for coupling or disconnecting the two lift rods 32, 34, a lift mechanism 36 for moving the lift rods 32, 34 upward and downward, and a lock mechanism 37 for locking the lift rod 34 to its bottom dead center of the stroke.

The container pushing-up and pushing-down lift rods 32, 34 extend through the bed 11.

Figure 2:
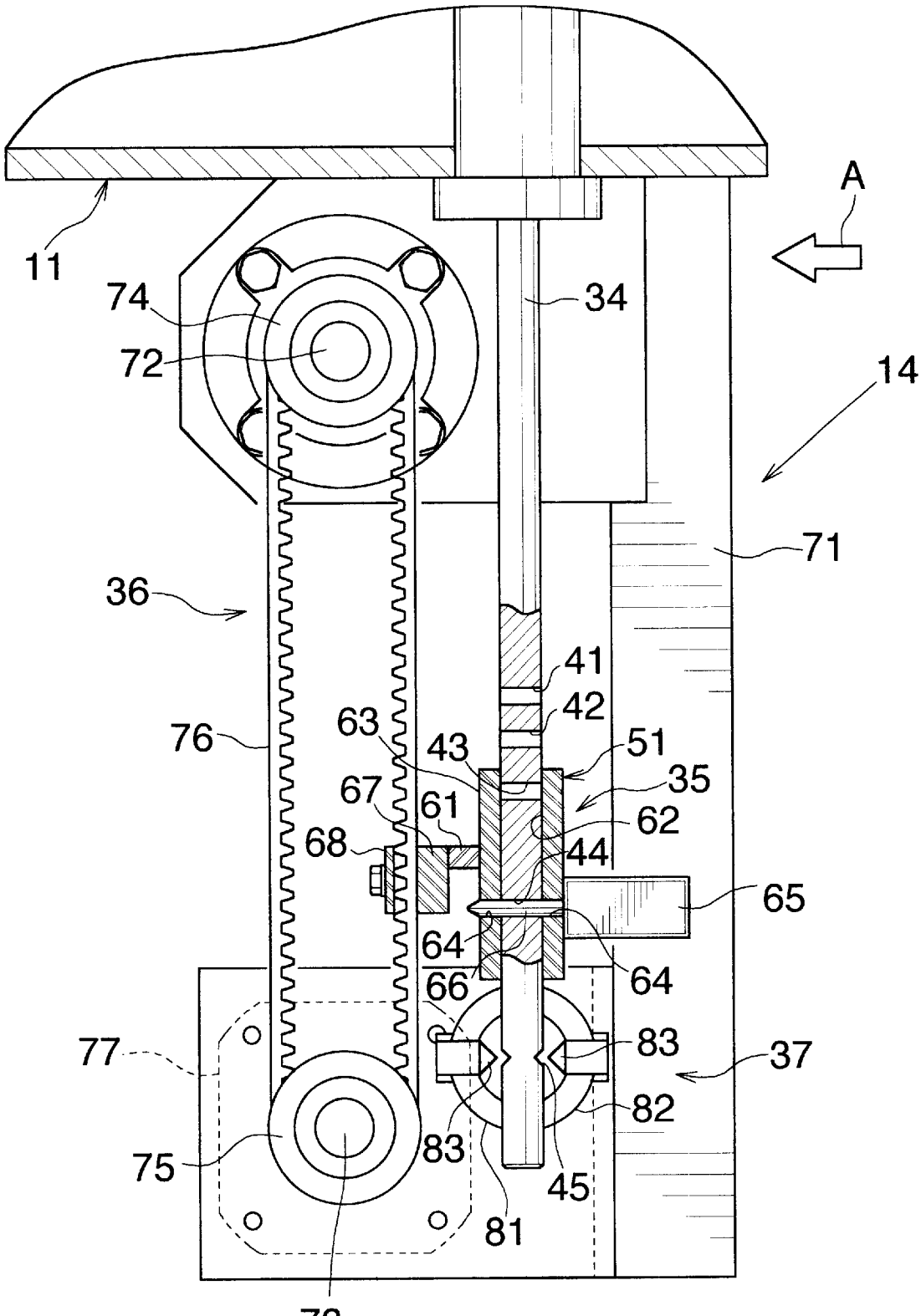
FIG. 2 is a view in vertical longitudinal section taken along the line II—II in FIG. 1.

As shown in detail in FIG. 2, the portion of the container pushing-down lift rod 34 projecting downward from the bed 11 has first to fourth four engaging bores 41 to 44 extending through the rod 34 from the front rearward and arranged from above downward. The first engaging bore 41 at the uppermost position is provided for the container C of the smallest height. The second engaging bore 42 and the third engaging bore 43 in this order correspond to containers C in the order of increasing height, and the fourth engaging bore 44 in the lowermost position corresponds to the container C of the greatest height. The intervals between these engaging bores 41 to 44 correspond to the differences in height between the four kinds of containers C. Below the fourth engaging bore 44, the projecting rod portion has a pair of V-shaped engaging notches 45 formed in the outer surface thereof and facing to the front and rear, and toward opposite directions.

The coupling mechanism 35 has a connector 51 positioned below the bed 11 and interconnecting the lift rods 32, 34.

Figure 3:
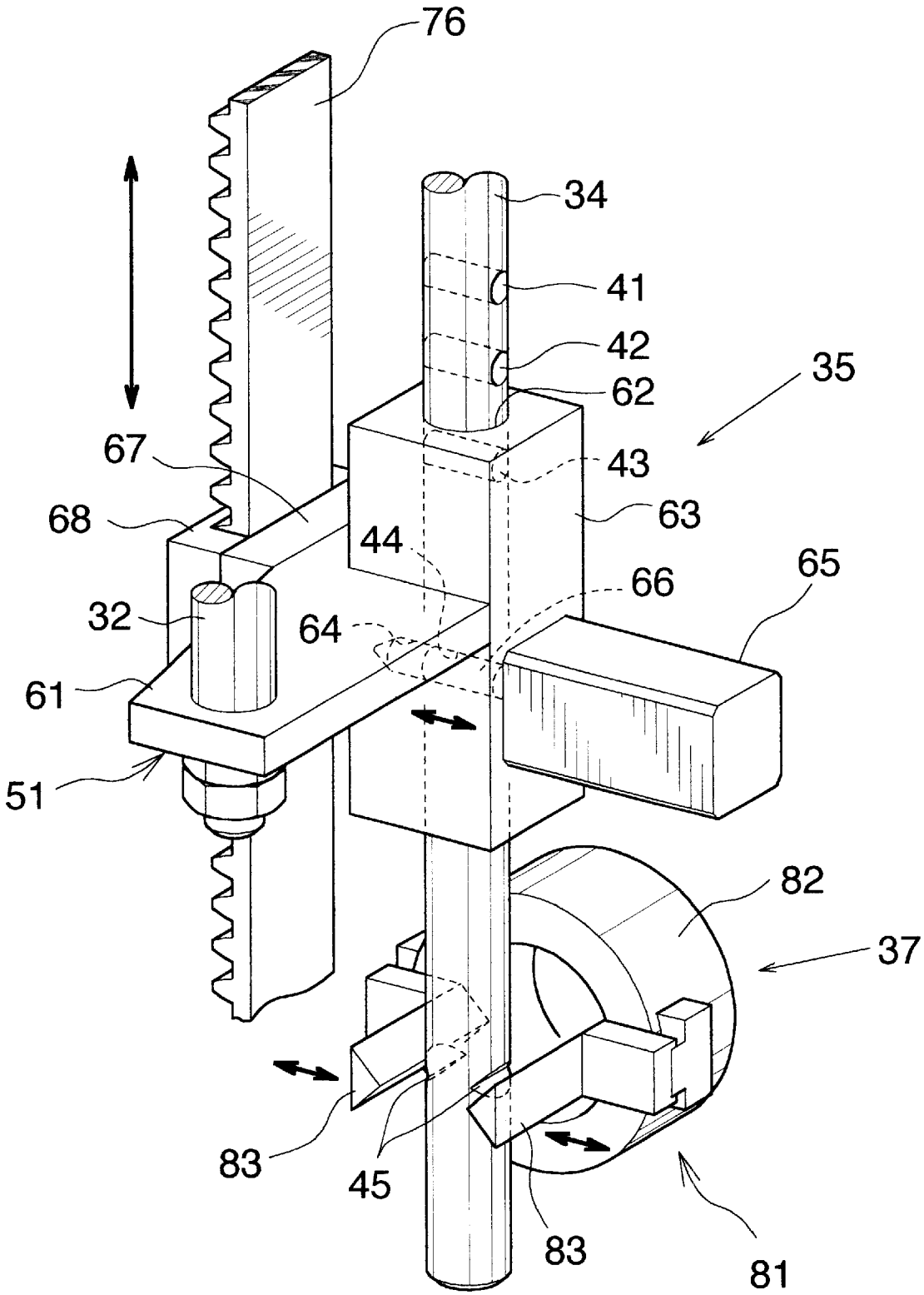
FIG. 3 is an enlarged perspective view showing part of the portion shown in FIG. 2.

As is shown best in FIG. 3, the connector 51 comprises a horizontal plate 61 having a left end secured to the lower end of the container pushing-up lift rod 32, and a vertical bored body 63 integral with the right end of the horizontal plate 61 and provided with a rod bore 62 having the container pushing-down lift rod 34 slidably extending therethrough.

The peripheral wall defining the rod bore 62 has a pair of front and rear guide holes 64 extending from front rearward therethrough in alignment. The guide holes 64 are shaped in conformity with the shape of the engaging bores 41 to 44.

The outer edge portion of the bored body 63 around the rear guide hole 64 is provided with a fluid pressure cylinder 65 directed horizontally forward and having a piston rod 66 movable into or out of the guide bore 64.

Positioned in front of the bored body 63 is a belt support 67 in the form of a vertical plate and provided on the front edge of the horizontal plate 61. A belt holder 68 is removably attached to the belt support 67.

Referring to FIGS. 1 and 2 again, the lift mechanism 36 comprises a driven shaft 72 and a drive shaft 73 which extend from left to right and which are vertically spaced apart and mounted on a bracket 71 extending downward from the lower side of the bed 11 at the right of and obliquely in the rear of the two lift rods 32, 34, a driven sprocket 74 and a drive sprocket 75 which are mounted respectively on the driven shaft 72 and the drive shaft 73 at their left ends so as to be positioned exactly in front of the container pushing-up lift rod 34, a toothed belt 76 reeved around these sprockets 74, 75, and a servomotor 77 having an output shaft connected to the drive shaft 73.

The rear-side straight movable portion of the belt 76 is movable through a position immediately in front of the lift rod 34 and is fixedly held between the belt support 67 and the belt holder 68.

As shown best in FIG. 3, the lock mechanism 37 comprises an air chuck 81. The air chuck 81 comprises a body 82, and a pair of openable pawls 83 projecting from the body 82. The body 82 is attached to the bracket 71 to cause the pawls 83 to hold the container pushing-down lift rod 34 therebetween from the front and rear or to release the rod.

When the toothed belt 76 is driven forward or reversely by the operation of the motor 77, the connector 51 is moved up or down with the movement of the belt 76. With the piston rod 66 fitted in one of the first to fourth engaging bores 41 to 44, the lift rods 32, 34 are moved up or down with the connector 51.

The distance between the container support 31 and the container holder 33 is made greater than the height of the container C by a distance corresponding to a predetermined clearance. When the two lift rods 32, 34 are positioned at the bottom dead center of their vertical stroke, the container support 31 is positioned at the same level as the rail 22, positioning the container holder 33 at a level higher than the level of the upper end of the container C as supported by the rail 22 by the distance of predetermined clearance. The level of the container holder 33 at this time is definite regardless of the height of containers C because the level of the rail 22 is so adjusted as to position the upper ends of the containers C of different heights at a constant level as already stated.

For filling, the two lift rods 32, 34 are raised along with the container support 31 and the container holder 33, raising the container C from the conveyor 12 to fit the container C around the filling nozzle 13. When the lift rods 32, 34 are brought to the top dead center, the bottom face of the container C as received by the container support 31 and the lower end of the filling nozzle 13 are opposed to each other as spaced apart by a predetermined filling distance. When the liquid to be filled is thereafter discharged from the filling nozzle 13, the liquid level inside the container C gradually rises, while the lift rods 32, 34 are lowered so as to hold the filling distance between the rising liquid level and the lower end of the nozzle 13.

Figure 4:
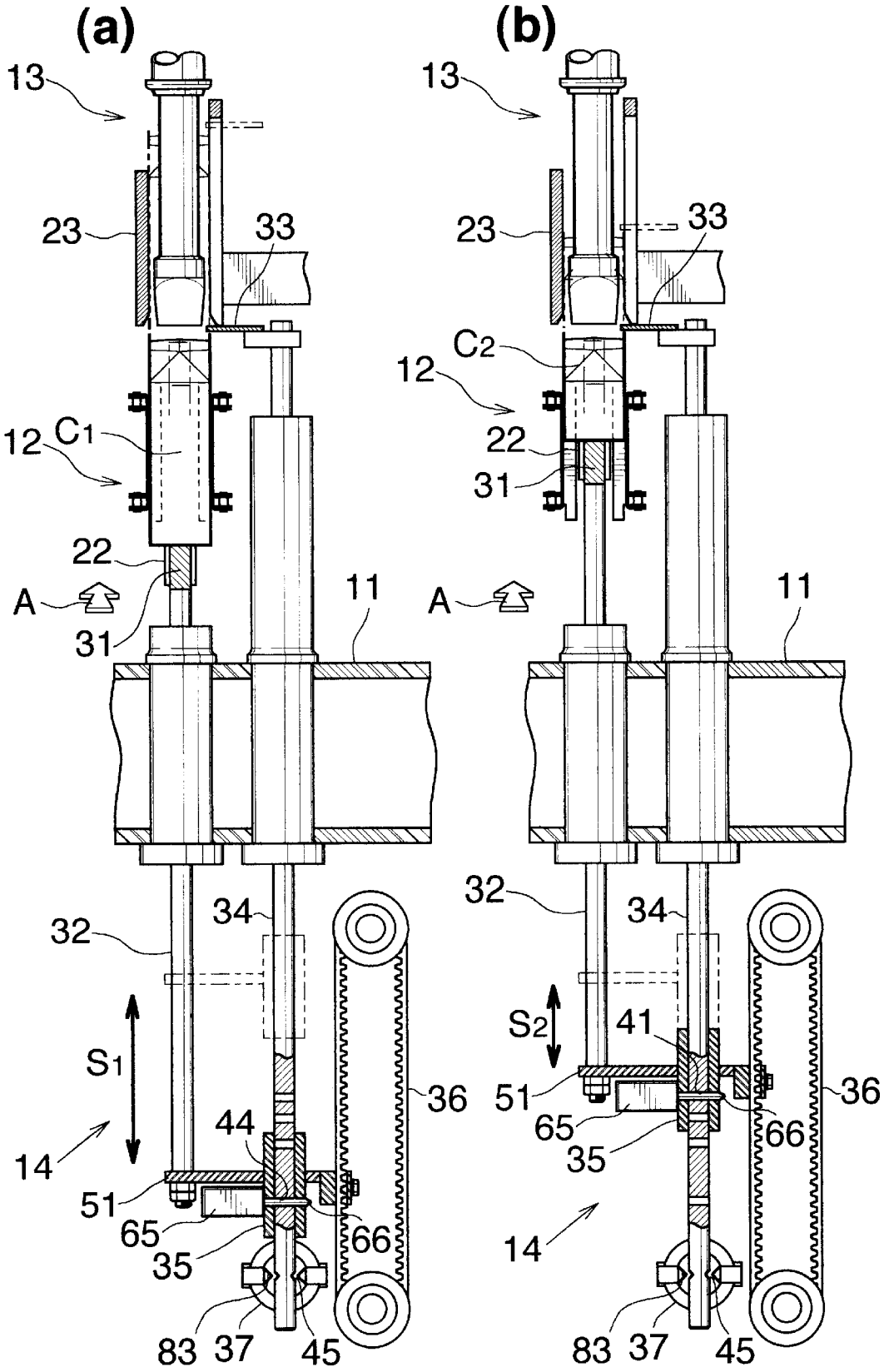
FIG. 4 includes views for illustrating a container change-over operation.

FIG. 4(*a*) shows a filling operation for containers C1 of the greatest height, while FIG. 4(*b*) shows a filling operation for containers C2 of the smallest height.

FIG. 4(*a*) shows the piston rod 66 as fitted in the fourth engaging bore 44. The lift rods 32, 34 are moved up and down with a stroke S1 corresponding to containers C1 of the greatest height.

A change-over from containers C1 of the greatest height to containers C2 of the smallest height is effected in the following manner.

The lift rods 32, 34 are lowered. Upon the rods 32, 34 reaching the bottom dead center, the air chuck 81 is actuated to engage the pawls 83 in the notches 45, whereby the container pushing-down lift rod 34 is restrained from moving upward or downward. In this state, the piston rod 66 is withdrawn from the fourth engaging bore 44, rendering the connector 51 free to move upward or downward relative to the lift rod 34. The motor 77 is operated to drive the belt 76 clockwise in FIG. 4 and raise the connector 51 along with the container pushing-up lift rod 32. Upon the connector 51 reaching a level where the guide holes 64 are in alignment with the first engaging bore 41, the rise is discontinued. The fluid pressure cylinder 65 is then operated to fit the piston rod 66 into the first engaging bore 41. The lift rods 32, 34 are thereafter moved upward and downward with a stroke S2 corresponding to the container C2 of the lowest height.

What is claimed is:

1. A liquid metering and filling lifter for use with different kinds of containers having different heights for moving the container upward and downward with a stroke corresponding to the height of the container in filling a liquid into the container, the lifter comprising:

a container pushing-up vertical lift rod disposed below a filling nozzle above a bed and extending through the bed, the lift rod including a container support fixed to an upper end thereof, a container pushing-down vertical lift rod extending through the bed at one side of the lift rod and including a container holder fixed to an upper end thereof, and coupling means disposed below the bed for coupling the two lift rods to make the lift rods moveable upward or downward together and uncoupling the lift rods relatively slideable along an upward or downward direction, without changing lengths of the two lift rods, whereby a distance between the container support and the container holder, along the upward or downward direction, is adjustable.

2. A liquid metering and filling lifter according to claim 1 wherein the coupling means comprises a connector interconnecting the two lift rods, and the connector is fixed to one of the lift rods and disengageably engaged with the other lift rod shiftably longitudinally thereof.

3. A liquid metering and filling lifter according to claim 1 wherein the coupling means has a connector fixed to the container pushing-up lift rod, and the connector is provided with a vertical rod bore having the container pushing-down lift rod slidably inserted therethrough, the container pushing-down lift rod having a plurality of engaging bores radially extending therethrough and arranged at intervals corresponding to the differences between the containers in height, a connecting rod being movable into or out of the connector radially of the rod bore and selectively fittable into one of the engaging bores when moved into the connector.

4. A liquid metering and filling lifter according to claim 3 which further comprises lock means for releasably locking the container pushing-down lift rod at a bottom dead center of the lift stroke thereof.

5. A liquid metering and filling lifter according to claim 4 wherein the container pushing-down lift rod is provided in an outer surface thereof with a horizontal engaging groove, and the lock means has an engaging member movable into or out of the engaging groove when the container pushing-down lift rod is positioned at the bottom dead center of the lift stroke thereof.

6. A liquid metering and filling lifter according to any one of claims 2 to 5 wherein a vertical endless belt is disposed along a path of upward and downward movement of the connector, with a one-side straight moving portion of the belt opposed to the path, the connector being fixed to the straight moving portion, and the endless belt is driven by a motor which is variable in the amount of rotation.

* * * * *